US007680560B2

(12) United States Patent
Hanada et al.

(10) Patent No.: US 7,680,560 B2
(45) Date of Patent: Mar. 16, 2010

(54) SHEET STACKING APPARATUS, SHEET PROCESSING APPARATUS AND IMAGE FORMING APPARATUS

(75) Inventors: Takako Hanada, Yokohama (JP); Kenichi Hayashi, Abiko (JP); Keiko Fujita, Kashiwa (JP); Toshiyuki Miyake, Toride (JP); Yasuo Fukatsu, Abiko (JP); Takayuki Fujii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 703 days.

(21) Appl. No.: 11/463,719

(22) Filed: Aug. 10, 2006

(65) Prior Publication Data

US 2007/0045948 A1 Mar. 1, 2007

(30) Foreign Application Priority Data

Aug. 30, 2005 (JP) ..... 2005-249994

(51) Int. Cl.
*G06F 7/00* (2006.01)

(52) U.S. Cl. ..... 700/213

(58) Field of Classification Search ..... 700/213; 271/290, 298, 289, 292, 288, 227
See application file for complete search history.

(56) References Cited

U.S. PATENT DOCUMENTS 6,189,882 B1 * 2/2001 Horiuchi et al. ..... 271/65
6,231,045 B1 * 5/2001 Yamada et al. ..... 271/292
6,295,081 B1 * 9/2001 Kashima et al. ..... 347/262
6,315,288 B1 * 11/2001 Sugishima et al. ..... 271/303
6,322,070 B2 * 11/2001 Yamada et al. ..... 271/293
6,494,453 B1 * 12/2002 Yamada et al. ..... 271/288
7,281,707 B2 * 10/2007 Moriyama et al. ..... 270/58.04
2004/0207152 A1 * 10/2004 Watanabe et al. ..... 271/294
2005/0179190 A1 8/2005 Kamiya et al. ..... 270/58.07
2005/0212194 A1 9/2005 Moriyama et al. ..... 270/58.08
2006/0061032 A1 3/2006 Kamiya et al. ..... 271/221
2006/0202412 A1 * 9/2006 Matsue et al. ..... 271/292
2006/0261543 A1 11/2006 Miyake et al. ..... 271/292

FOREIGN PATENT DOCUMENTS

JP 1-137956 9/1989
JP 10-305961 11/1998
JP 2001-26359 1/2001
JP 2001-72325 3/2001

* cited by examiner

*Primary Examiner*—Gene Crawford
*Assistant Examiner*—Ramya Prakasam
(74) *Attorney, Agent, or Firm*—Fitzpatrick, Cella, Harper & Scinto

(57) ABSTRACT

A recording material stacking apparatus equipped with a plurality of discharge ports and a plurality of stacking trays can be set to normal mode and large capacity stacking mode each having a different maximum loading capacity. A stacking tray on the upper side has a plurality of lower limit positions and uses a lower limit position located on the upper side when normal mode is selected. On the other hand, it uses a lower limit position located on the lower side when the large capacity stacking mode is selected. The lower limit position located below a stacking tray on the upper side when this large capacity stacking mode is selected exists at a position in which it blocks a lower discharge port of sheets. Selection of the large capacity stacking mode and normal mode is executed according to a result of computation from data input through an input portion.

13 Claims, 12 Drawing Sheets

SHEET STACKING APPARATUS, SHEET PROCESSING APPARATUS AND IMAGE FORMING APPARATUS

BACKGROUND OF THE INVENTION

1. Field of the Invention

The present invention relates to a sheet stacking apparatus, a sheet processing apparatus and an image forming apparatus, and the present invention is preferably applied to a sheet processing apparatus which is stacked with sheets output from an image forming apparatus such as a copying machine, a laser beam printer and a processing apparatus or an image forming apparatus equipped with the same sheet processing apparatus.

2. Description of the Related Art

Japanese Patent Application Laid-Open No. 10-305961 has disclosed a sheet post-processing unit as a sheet stacking apparatus. This sheet post-processing unit has two or more stacking trays and a function of lifting up/down a stacking tray when sheets stacked in that stacking tray reaches a maximum loading capacity of the tray and changing over the stacking tray for stacking following sheets.

A variety of devices for increasing a loading capacity in the sheet stacking apparatus having a plurality of trays have been known. More specifically, according to Japanese Patent Application Laid-Open No. 2001-72325, when it is detected that a tray to which sheets are discharged currently becomes full in a stacking apparatus having a plurality of bin trays, a tray unit located above the tray which is currently receiving discharged sheets is lifted upward so as to increase the loading capacity of the tray which is currently receiving the discharged sheets.

However, the related art described in the Japanese Patent Application Laid-Open No. 2001-72325 has such a problem that although the loading capacity of the tray which is currently receiving discharged sheets can be increased, the loading capacity of the stacking tray located above is decreased by the same amount as an increase of the loading capacity.

SUMMARY OF THE INVENTION

Accordingly, an object of the present invention is to provide a sheet stacking apparatus and a sheet processing apparatus in which a maximum loading capacity of the entire apparatus is increased avoiding enlargement of the size of the apparatus and increase in cost and an image forming apparatus provided with the same sheet processing apparatus.

To achieve the above-described object, according to a first aspect of the present invention, there is provided a sheet stacking apparatus comprising: a plurality of discharge ports disposed on the upper/lower sides in order to discharge sheets; a stacking portion having a plurality of stacking trays capable of stacking sheets discharged from the discharge ports and moving vertically; and a controller which controls the vertical motion of the plurality of the stacking trays, wherein the controller is capable of setting first mode and second mode in which the lower limit position of the stacking tray stacked with sheets discharged from one discharge port of the plurality of the discharge ports is different;

the lower limit position of the stacking tray on the first mode is above a discharge port located below the one discharge port;

the lower limit position of the stacking tray on the second mode is a position in which the stacking tray or sheets stacked on the stacking tray blocks a discharge port located below the one discharge port and above the top surface of sheets of the maximum loading capacity stacked on a stacking tray located below the plurality of the stacking trays;

and the controller executes change-over between the first mode and the second mode depending on the total quantity of sheets scheduled to be discharged to the plurality of the stacking trays.

A second aspect of the present invention provides an image forming apparatus equipped with the sheet stacking apparatus of the first aspect of the invention. A third aspect of the present invention provides a sheet processing apparatus equipped with the sheet stacking apparatus of the first aspect of the invention. Further, a fourth aspect of the present invention provides an image forming apparatus equipped with the sheet processing apparatus of the third aspect of the invention.

The present invention enables provision of a sheet stacking apparatus in which the maximum loading capacity of the entire apparatus can be increased without enlargement of the size of the apparatus and increase in cost and no interference between trays is generated when sheets of the maximum loading capacity are stacked, a sheet processing apparatus and an image forming apparatus having the same sheet stacking apparatus.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
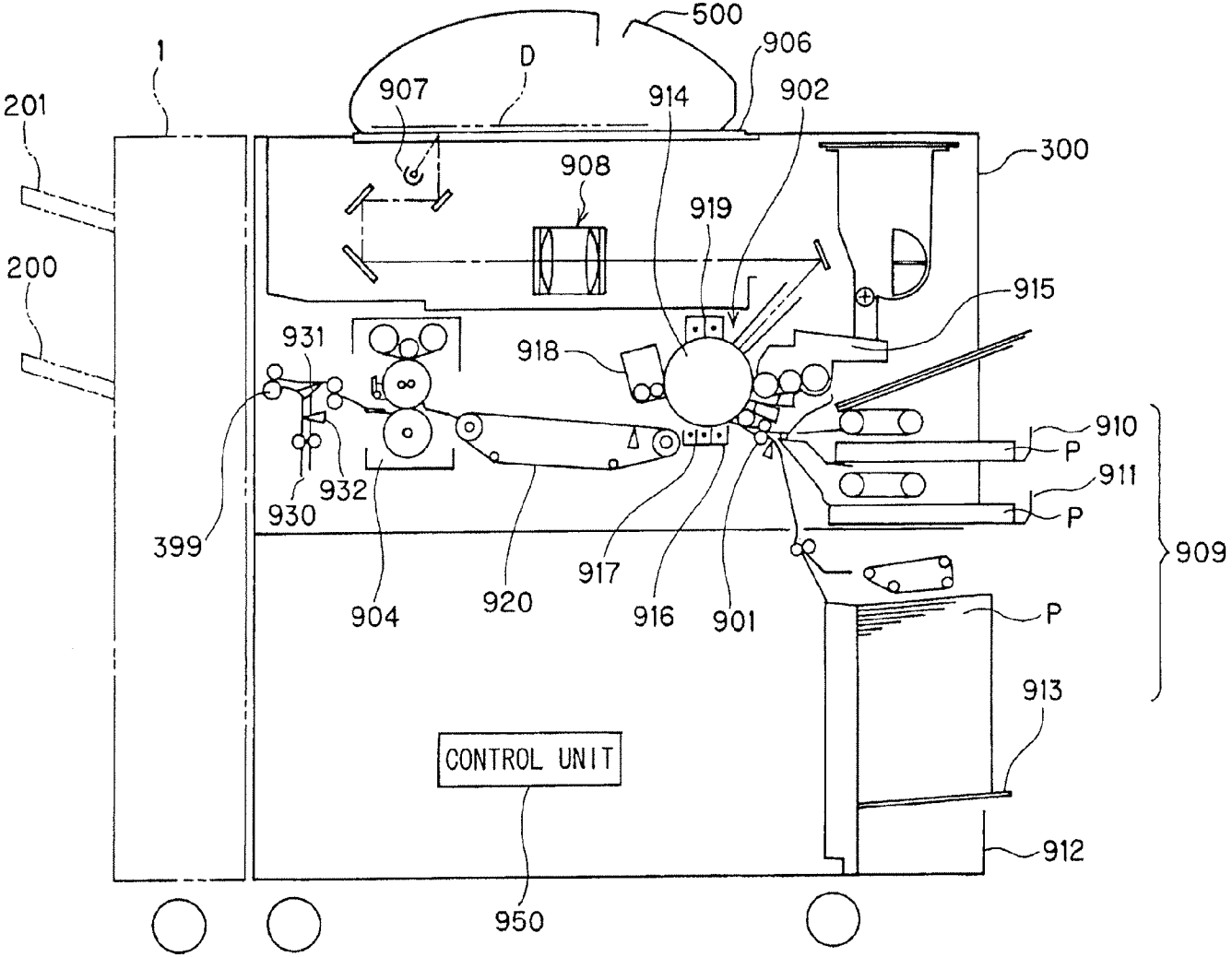
FIG. 1 is a schematic diagram showing an image forming apparatus connected to a sheet processing apparatus of one embodiment of the present invention.

Hereinafter, an embodiment of the present invention will be described with reference to the accompany drawings. Like reference numerals are attached to the same components or corresponding ones in all drawings of the embodiment. The dimension, material shape and relative arrangement of the components described in this embodiment may be changed appropriately depending on the structure of an apparatus to which the present invention is applied or a variety of conditions and the scope of the invention is not restricted to embodiments described below. FIG. 1 shows an image forming apparatus as a sheet stacking apparatus of a first embodiment of the present invention.

(Entire Structure of Image Forming Apparatus)

As shown in FIG. 1, the image forming apparatus as the sheet stacking apparatus of this embodiment comprises an image forming apparatus main body 300 (copying machine main body) and a sheet processing apparatus 1 connected to the image forming apparatus main body 300. The image forming apparatus main body 300 comprises a resisting roller 901, an image forming portion 902, a document base 906 constituted of a platen glass, a light source 907, a lens system 908, a sheet feeding portion 909 and an automatic document feeding unit 500 for feeding a document to the document base 906.

The sheet processing apparatus 1 stacked with a sheet on which an image is formed discharged from this image forming apparatus main body 300 is connected to the image forming apparatus main body 300. The sheet processing apparatus 1 includes a stack tray 200 and a sample tray 201 as a plurality of stacking trays which are at stacking portion of the present invention.

The sheet feeding portion 909 includes cassettes 910, 911 detachably attached to the image forming apparatus main body 300 while accommodating recording sheets P and a deck 913 disposed on a pedestal 912.

The image forming portion 902 as a image forming portion has a photosensitive drum 914 as a cylindrical image bearing member. This image forming portion 902 comprises a development unit 915, a transfer charger 916, a separation charger 917, a cleaner 918 and a primary charger 919, disposed successively around the photosensitive drum 914. A conveying unit 920, a fixing unit 904 and a pair of discharge rollers 399 are disposed in order in the downstream side of the image forming portion 902.

The image forming apparatus main body 300 has a control unit 950 as a controller for controlling the respective components of this image forming apparatus. This control unit 950 includes, for example, CPU and memory units such as ROM, RAM for storing information data, the details are described below.

(Image Forming Apparatus Main Body)

Next, an operation of the image forming apparatus main body of one embodiment of the present invention will be described. That is, if a sheet feeding signal is output from the control unit 950 provided on the image forming apparatus main body 300, a sheet P is fed as a sheet from the cassettes 910, 911 or the deck 913.

One the other hand, light irradiated from the light source 907 to a document D placed on the document base 906 is reflected by the surface of the document D. This reflected light is irradiated to the photosensitive drum 914 through the lens system 908. Then, light is irradiated to the photosensitive drum 914 previously charged by the primary charger 919. An electrostatic latent image is formed on the photosensitive drum 914. This electrostatic latent image is developed by the development unit 915 so as to form a toner image.

Next, skew of a sheet P fed from the sheet feeding portion 909 is corrected by the resisting roller 901. The sheet is conveyed to the image forming portion 902 with an appropriate timing. A toner image is transferred from the photosensitive drum 914 to the sheet P fed to the image forming portion 902 by the transfer charger 916. After the toner image is transferred, the sheet P is charged with a polarity opposite to that of the transfer charger 916 by the separation charger so that it is separated from the photosensitive drum 914.

The separated sheet P is conveyed to the fixing unit 904 by the conveying unit 920. Then, a transferred image is permanently fixed on the sheet P by the fixing unit 904. After the image is fixed, the sheet P is discharged from the image forming apparatus main body 300 by a pair of the discharge rollers 399 on straight discharge mode in which an image side faces up or reverse discharge mode in which the sheet is reversed after it is conveyed to the sheet reverse pass 930 after the image is fixed so that the image face faces down. After an image is formed on the sheet P fed from the sheet feeding portion 909, the sheet is conveyed to the sheet processing apparatus 1.

(Description of Sheet Processing Apparatus)

Next, the sheet processing apparatus 1 of this embodiment will be described.

Figure 2:
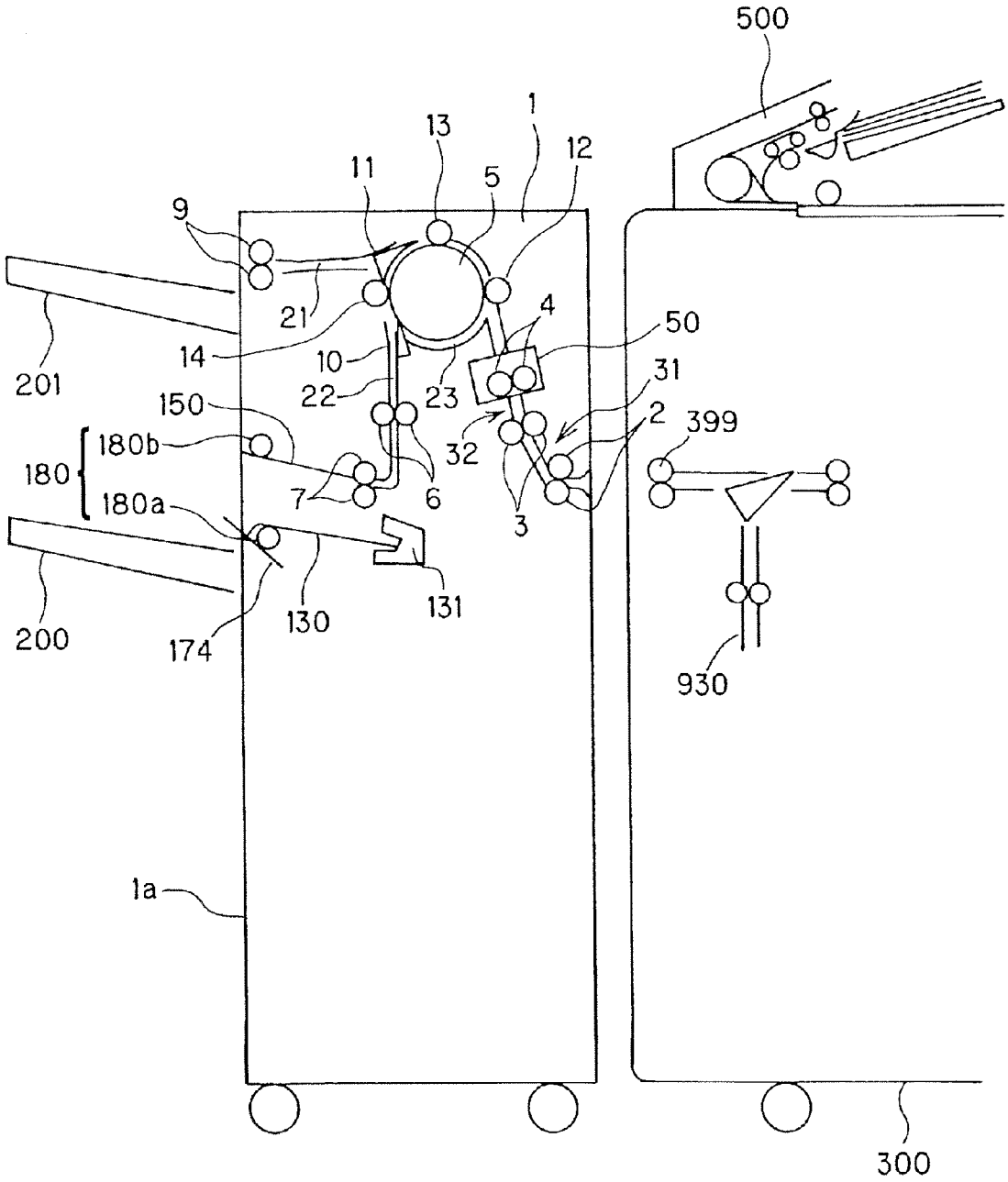
FIG. 2 is a schematic diagram showing the sheet processing apparatus of one embodiment of the present invention.

As shown in FIG. 2, in this embodiment, the sheet processing apparatus 1 is connected to the image forming apparatus main body 300. A sheet P discharged from the pair of the discharge rollers 399 of the image forming apparatus main body 300 is fed to the pair of the entrance rollers 2, 3 in the sheet processing apparatus 1. The pair of the entrance rollers 2, 3 in the sheet processing apparatus 1 are conveyance rollers which can move in a direction perpendicular to the conveyance direction. A sheet detecting sensor 31, sideways resistance detecting sensor 32 for detecting the side end face of a sheet parallel to the conveyance direction, and a punch unit 50 having a punch die 4 which punches near the rear end of a conveyed sheet are provided in order on the conveying path. A conveyance large roller 5 is so constructed to convey the sheet P while the sheet P is pressed by pressing rollers 12, 13, 14.

A switching flapper 11 can switch a non-sort pass 21 and a sort pass 22. The sheet P after passing the non-sort pass 21 is discharged to the sample tray 201 as a stacking tray located on the upper side through the pair of the discharge rollers 9 located on the upper side so that it is stacked therein. A discharge port for discharging the sheet with the pair of the discharge rollers 9 located on the upper side corresponds to the sample tray 201.

This sample tray 201 can be moved vertically by a motor (not shown) based on a result of detection of a sheet surface detecting sensor S1 in order to always keep the top face of the sample tray at an optimum position for discharge. The switching flapper 11 switches the sort pass 22 and a buffer pass 23 in which the sheet P is deposited temporarily.

The sample tray 201 can be moved to below the discharge port from which the sheet is discharged by a pair of sheet bundle discharge rollers 180 described later. When it is moved to below the discharge port, a swing guide 150 is moved to a closed position thereby forming a lift guide for the sample tray 201. The sample tray 201 can receive a sheet discharged from the pair of the sheet bundle discharge rollers 180.

On the other hand, the sort pass 22 has a conveyance roller 6 and a discharge roller 7. Further, a processing tray 130 in which the sheets are collected temporarily and arranged and stapled by a stapler 131 as a post-processing unit is provided as an intermediate tray and the sheet P is discharged onto this processing tray 130 by the discharge roller 7.

A front end thrust member 174 which thrusts the front end of a sheet P discharged and the swing guide 150 are provided. A bundle discharge upper roller 180*b* supported by this swing guide 150 conveys the sheet P in a bundle on the processing tray 130 in cooperation with a bundle discharge lower roller 180*a* disposed on the processing tray 130 when the swing guide 150 comes to the closed position and discharges it in a bundle onto the stack tray 200 as a stacking tray located on the lower side.

The pair of the sheet bundle discharge rollers 180 comprised of the bundle discharge lower roller 180*a* and the bundle discharge upper roller 180*b* form a discharge port for discharging the sheet bundle on the processing tray 130 onto the stack tray 200. Consequently, the discharge port for discharging the sheet from the pair of the sheet bundle discharge rollers 180 corresponds to the stack tray 200. This stack tray 200 can be moved vertically by a motor (not shown) based on a result of detection of the sheet surface detecting sensor S2 in order to always keep the top surface at an appropriate position for discharge.

(Control Block Diagram)

Figure 3:
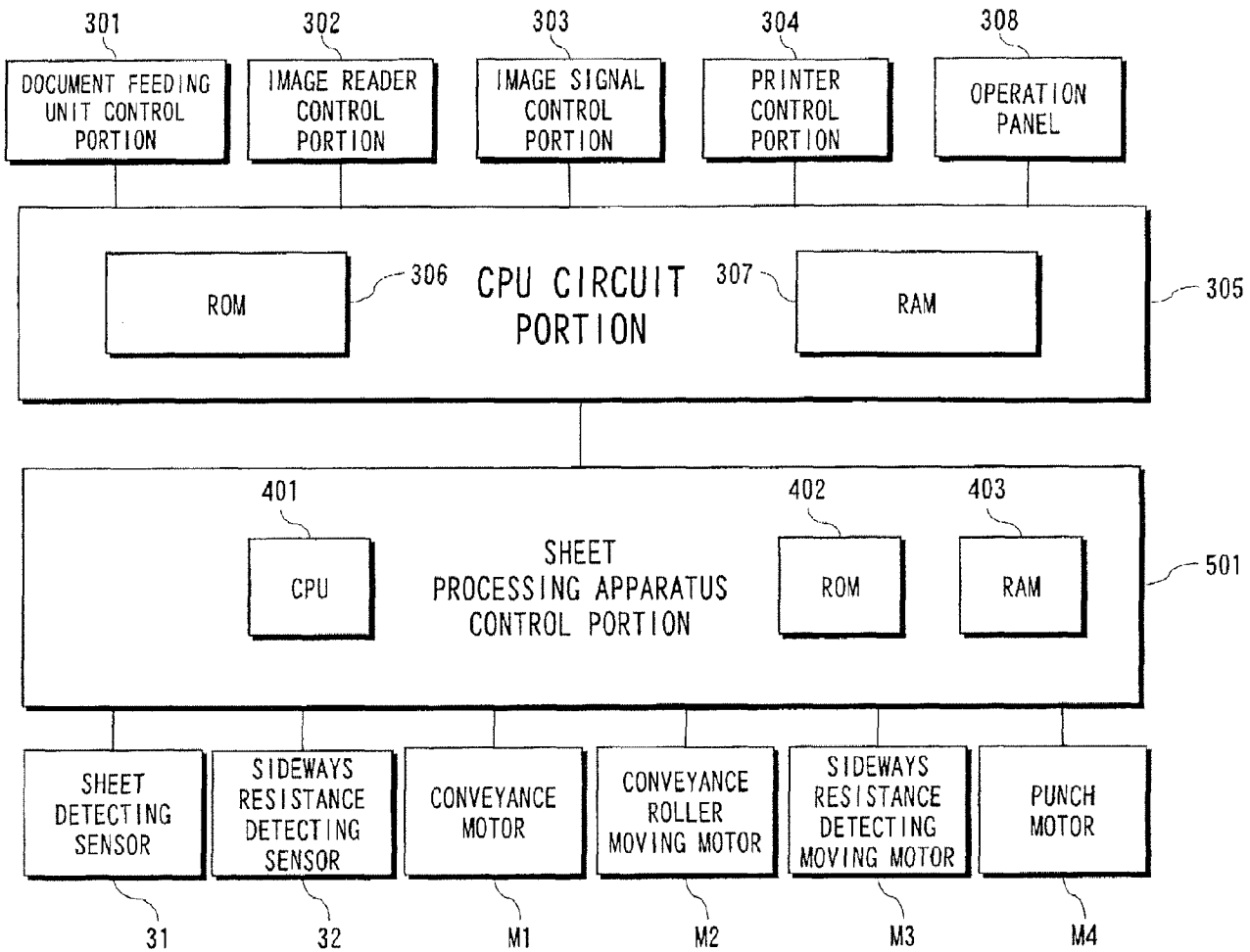
FIG. 3 is a block diagram showing a control unit of the image forming apparatus of one embodiment of the present invention.

Next, the control unit 950 as a controller for controlling entirely the image forming apparatus of this embodiment will be described. FIG. 3 shows the structure of the control unit 950 in the image forming apparatus main body 300 shown in FIG. 1.

As shown in FIG. 3, the control unit 950 has a CPU circuit portion 305. The CPU circuit portion 305 incorporates a CPU (not shown), ROM 306 and RAM 307 as memory unit. According to a control program stored in this ROM 306, it controls a document freeing unit control portion 301, an image reader control portion 302, an image signal control portion 303, a printer control portion 304, an operating portion 308 and a sheet processing apparatus control portion 501 synthetically, which are each of blocks. Further, the RAM 307 is used for holding control data temporarily and holding data as a work area for arithmetic operation accompanying the control.

The document feeding unit control portion 301 is a control portion for driving and controlling an automatic document feeding unit 500 (refer to FIGS. 1, 2) based on an instruction from the CPU circuit portion 305. The image reader control portion 302 drives and controls the aforementioned light source 907 and lens system 908 and transfers an analog image signal of RGB output from the lens system 908 to the image signal control portion 303.

The image signal control portion 303 converts RGB analog image signal from the lens system 908 to digital signal and executed various processing thereon so as to convert this digital signal to video signal and outputs to the printer control portion 304. The processing action of this image signal control portion 303 is controlled by the CPU circuit portion 305.

The operating portion 308 comprises a plurality of keys for setting various functions or image formation and a display portion 308*a* for displaying information indicating setting state. A key signal corresponding to each key operation of this operating portion 308 is supplied to the CPU circuit portion 305 which functions as a computing portion or an input portion. In the operating portion 308, corresponding information based on a signal from the CPU circuit portion 305 is displayed on the display portion 308*a*. In the meantime, the image forming apparatus main body 300 may be used as a printer by supplying information relating to image formation, quantity of outputs and the like from a personal computer (not shown) to the CPU circuit portion 305 which functions as a computing portion or an input portion.

The sheet processing apparatus control portion 501 is mounted on the above-described sheet processing apparatus 1 and can drive and control the sheet processing apparatus 1 entirely by communicating about information data with the CPU circuit portion 305 through communication IC (IPC) (not shown) The sheet processing apparatus control portion 501 includes CPU 401, ROM 402 and RAM 403.

Various actuators and various sensors are controlled based on a control program stored in the ROM 306. More specifically, sensors such as the sheet detecting sensor 31 and the sideways resistance detecting sensor 32 and actuators such as a, conveyance motor M1, a conveyance roller moving motor M2, sideways resistance detecting moving motor M3 and a punch motor M4 are controlled by the sheet processing apparatus control portion 501. The RAM 403 is used for holding control data temporarily or as a work area for arithmetic operation accompanying the control.

Various sensors and motors constituting the sheet processing apparatus 1 are controlled by the sheet processing apparatus control portion 501.

(Stacking Control)

Figure 4:
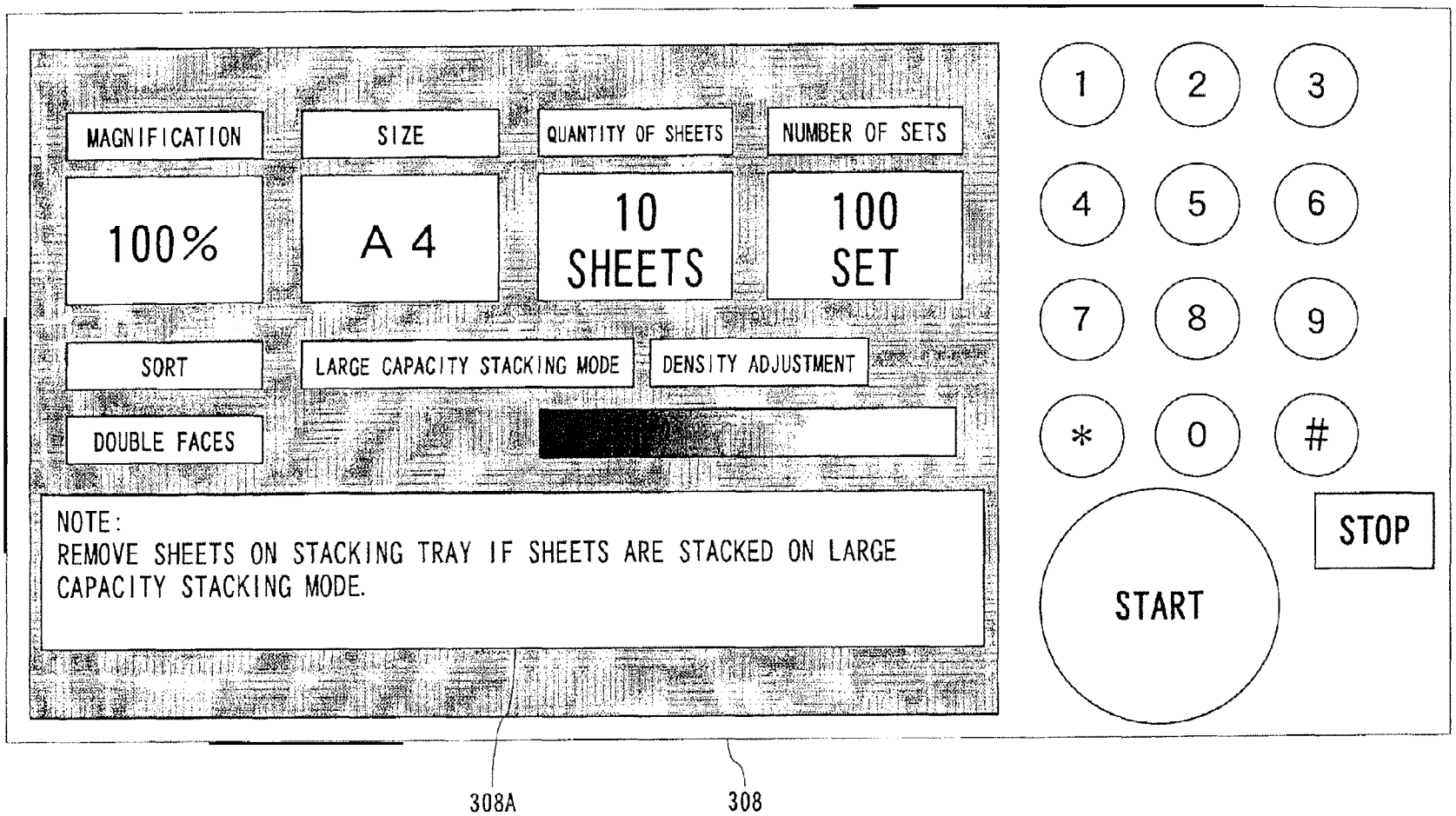
FIG. 4 is a schematic diagram showing an example of an operating portion according to one embodiment of the present invention.
Figure 6:
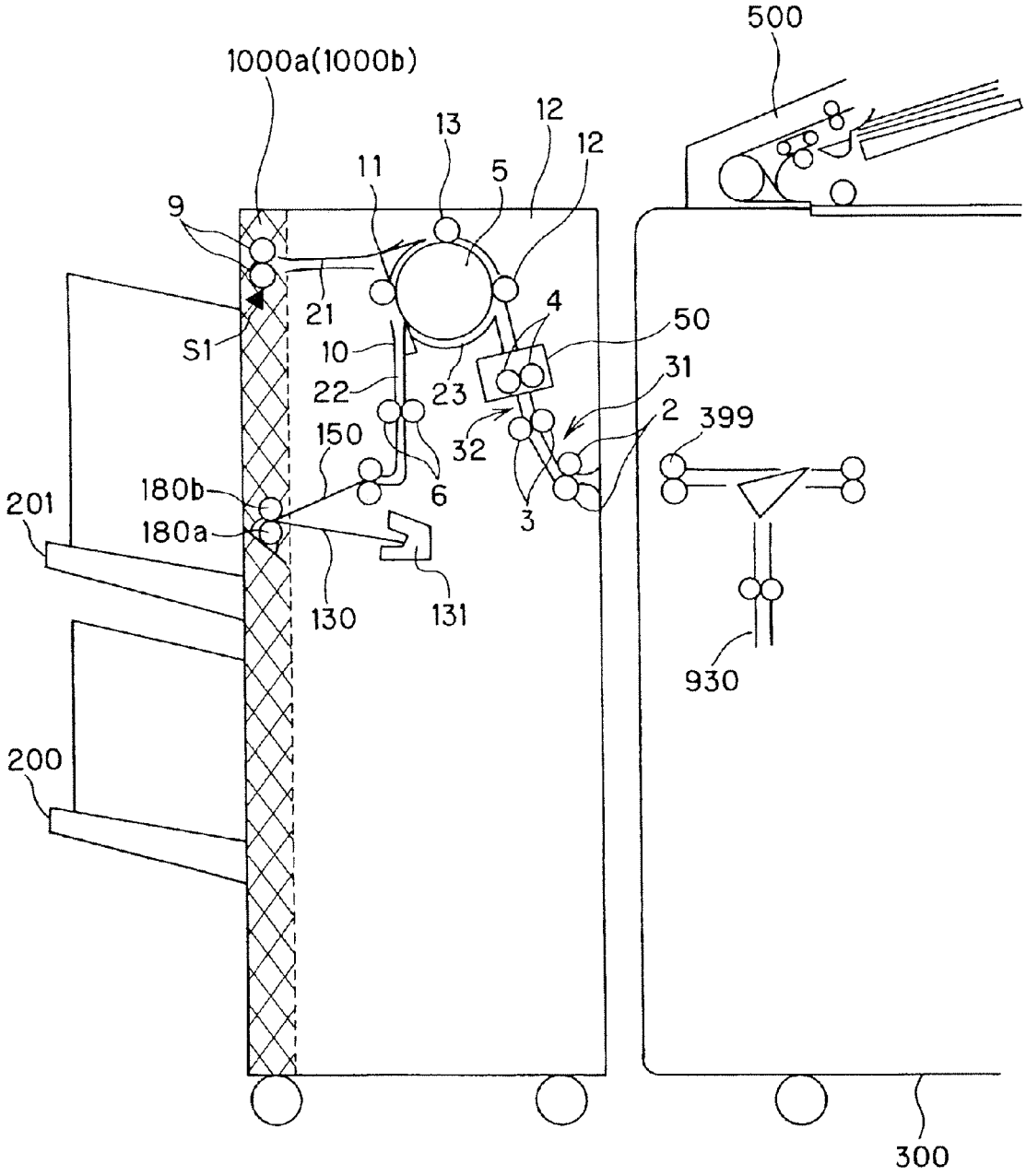
FIG. 6 is a schematic diagram showing a state in which the sample tray in the sheet processing apparatus of one embodiment of the invention is located at a lower limit position based on the large capacity stacking mode.
Figure 7:
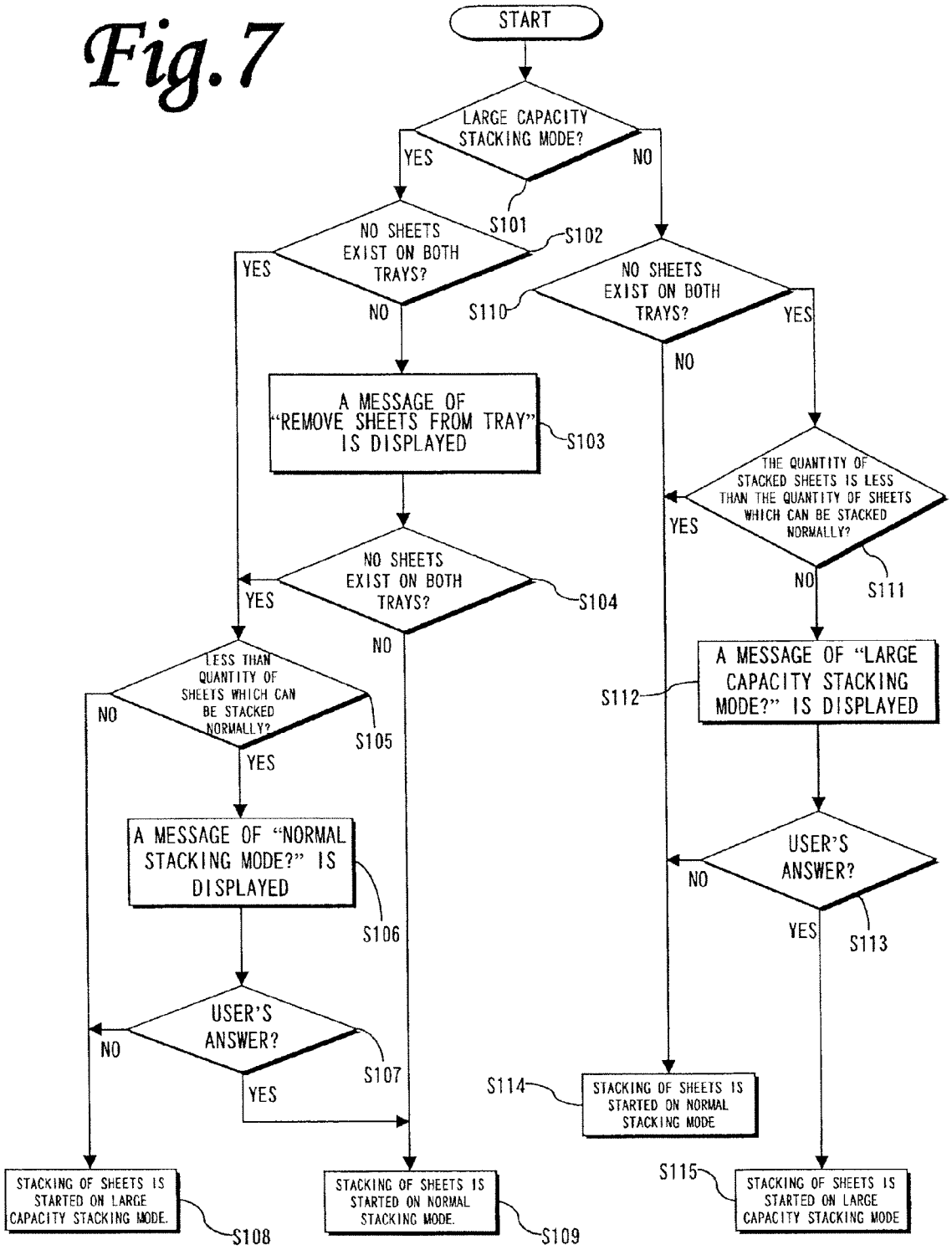
FIG. 7 is a flow chart for explaining stacking action based on the stacking mode of one embodiment of the invention.

Next, position control of the stack tray 200 and the sample tray 201 according to the embodiment of the present invention will be described. FIG. 4 shows the operating portion 308 which user inputs a command for this position control, FIGS. 5, 6 show a specific tray moving state and FIG. 7 shows a flow chart of this position control action.

In this embodiment, normal stacking mode as a first mode and large capacity stacking mode as a second mode are switched when user operates the operating portion 308. This stacking mode can be changed by initial setting. A state of the current stacking mode is displayed on the operating portion 308 for user to be able to see easily. An example of this state is shown in FIG. 4.

Figure 5:
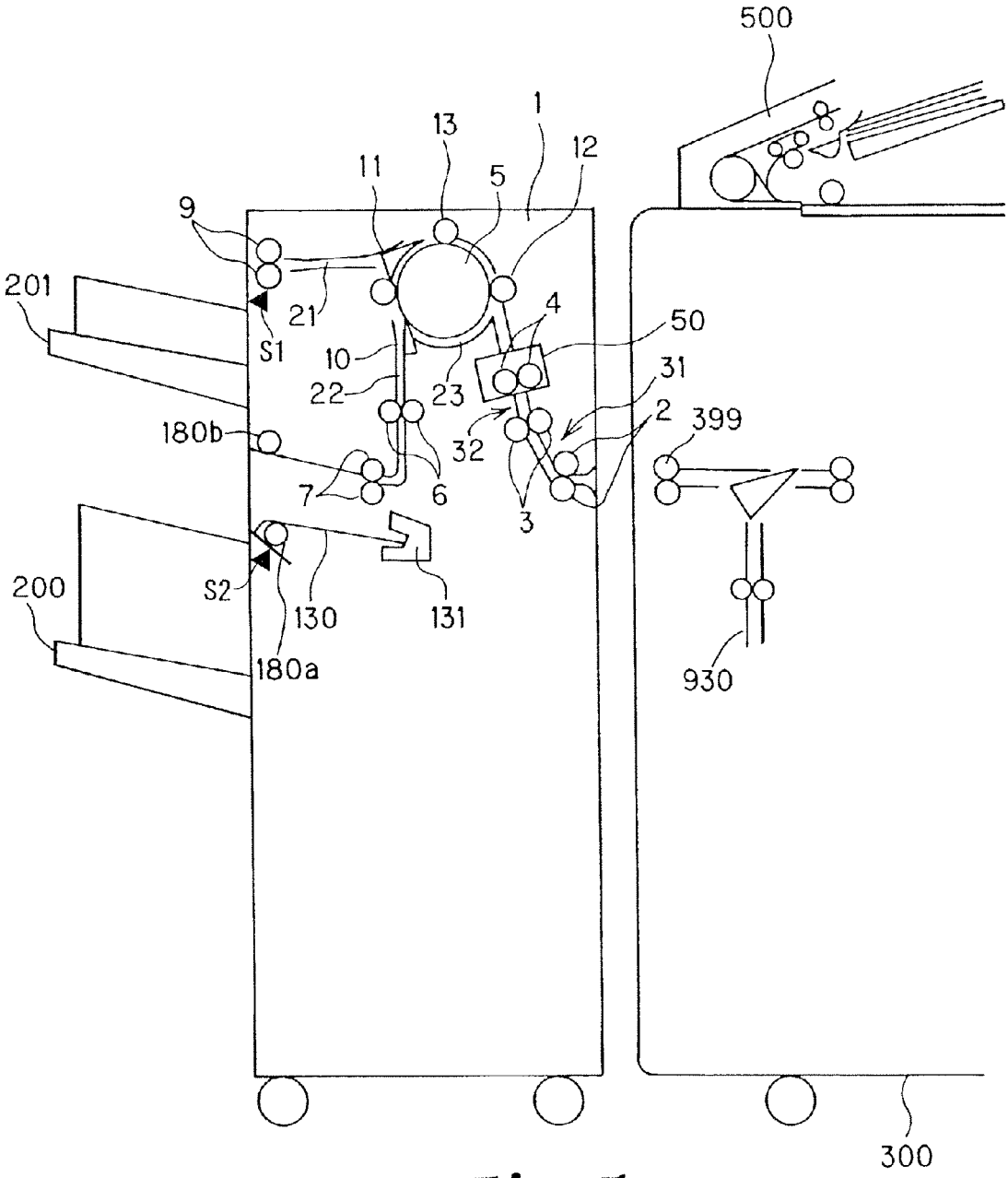
FIG. 5 is a schematic diagram showiness a state in which a sample tray in the sheet processing apparatus of one embodiment of the invention is located at a lower limit position based on normal stacking mode.

Assume that when the normal stacking mode is selected, for example, 1,000 sheets and 2,000 sheets can be stacked on the sample tray 201 and the stack tray 200 respectively as shown in FIG. 5 as an example. Further, assume that the sample tray 201 is descended to a position shown in FIG. 5 when 1,000 sheets are stacked on the sample tray 201. "A lower limit position of the sample tray 201 under the normal stacking mode" is set slightly below this position considering dispersion of paper thickness.

That is, it is so set that the sheet discharge port formed by the pair of the sheet bundle discharge rollers 180 for discharging the sheet to the stack tray 200 is not blocked even when the sample tray 201 is descended to the lower limit position under the normal stacking mode. Thus, the sheet can be discharged to the stack tray 200 as normally by the bundle discharge lower roller 180*a* and the bundle discharge upper roller 180*b*. Under this normal stacking mode, which the sheet is discharged first to the stack tray 200 or the sample tray 201 is not specified when the maximum pieces of the sheets are stacked.

On the other hand, assume that when the large capacity stacking mode is selected as a second mode, 3,000 sheets and 2,000 sheets can be stacked on the sample tray 201 and the stack tray 200 respectively. First, the sheets are discharged to the stack tray 200. If the stack tray 200 is full of the sheets, the sheets are discharged to the sample tray 201 next time. Conversely if the maximum pieces (3,000) of the sheets are stacked on the sample tray 201 first, the sample tray 201 blocks the sheet discharge port formed by the bundle discharge lower roller 180*a* and the bundle discharge upper roller 180*b*. Consequently, discharge of the sheets to the stack tray 200 is disabled. Therefore, in order to secure the maximum loading capacity of the entire apparatus, it is necessary to stack the maximum pieces of the sheets on the sample tray 201 after the stack tray 200 is stacked with the maximum pieces of the sheets.

in this embodiment, the sample tray 201 can be descended to the lower limit position below above-described "the lower limit position of the sample tray 201 under the normal stacking mode". This position is assumed to be "the lower limit position of the sample tray under the large capacity stacking mode". At this time, the sheet discharge port for discharging the sheets to the stack tray 200 is blocked by the sample tray 201 and the sheets stacked on the sample tray 201 as shown in FIG. 6. That is, "the lower limit position of the sample tray under the large capacity stacking mode" is set to the same position as or a position below the sheet discharge port for discharging the sheets to the stack tray 200.

The above-mentioned two modes are switched over according to a mode set by user. If sheets are already stacked on any of the stack tray 200 and the sample tray 201, a message as shown in FIG. 4 is displayed on the display portion 308*a* of the operating portion 308 to instruct user to remove the stacked sheets because how many sheets can be stacked further is not clear.

If the quantity of the sheets stacked on the sample tray 201 and the stack tray 200 reaches the maximum loading capacity or the sample tray 201 and the stack tray 200 reach the lower limit position under any mode of the normal stacking mode and large capacity stacking mode, the sheet loading capacity is judged to be "full" by the sheet processing apparatus control portion 501 and a message indicating the necessity of removing the sheets is displayed on the display portion 308*a* of the operating portion 308.

As a method for instructing user to remove the sheets stacked on the tray or notifying him that the tray is full of sheets stacked thereon, it is permissible to notify of the necessity of removing the stacked sheets with sound or using an illuminating portion such as a button on the operating portion 308 as well as the method of displaying the content on the display portion 308*a* of the operating portion 308.

If the total sheets output after the image forming processing (job) can be stacked under normal stacking mode even when the large capacity stacking mode is selected, a message is displayed on the operating portion 308. If user after recognizing the display of this message accepts the image formation and discharge of the sheets and operates the operating portion 308 correspondingly to execute the image forming processing, stacking of the sheets is started based on a specification by the normal stacking mode.

Conversely if the total quantity of the sheets output from a job is a quantity which cannot be stacked under the normal stacking mode when the normal stacking mode is selected, a message is displayed on the display portion 308*a* of the operating portion 308. When user after recognizing this message accepts the image formation and discharge of the sheets, the sheets are stacked based on a specification of the large capacity stacking mode. In these cases, acceptances by user are not always necessary but the respective modes may be automatically switched over. Further, even if three or more trays for stacking the sheets are provided, preliminary set stacking mode may be changed over corresponding to the total number of sheets output.

(Detection of Tray Position)

Figure 8:
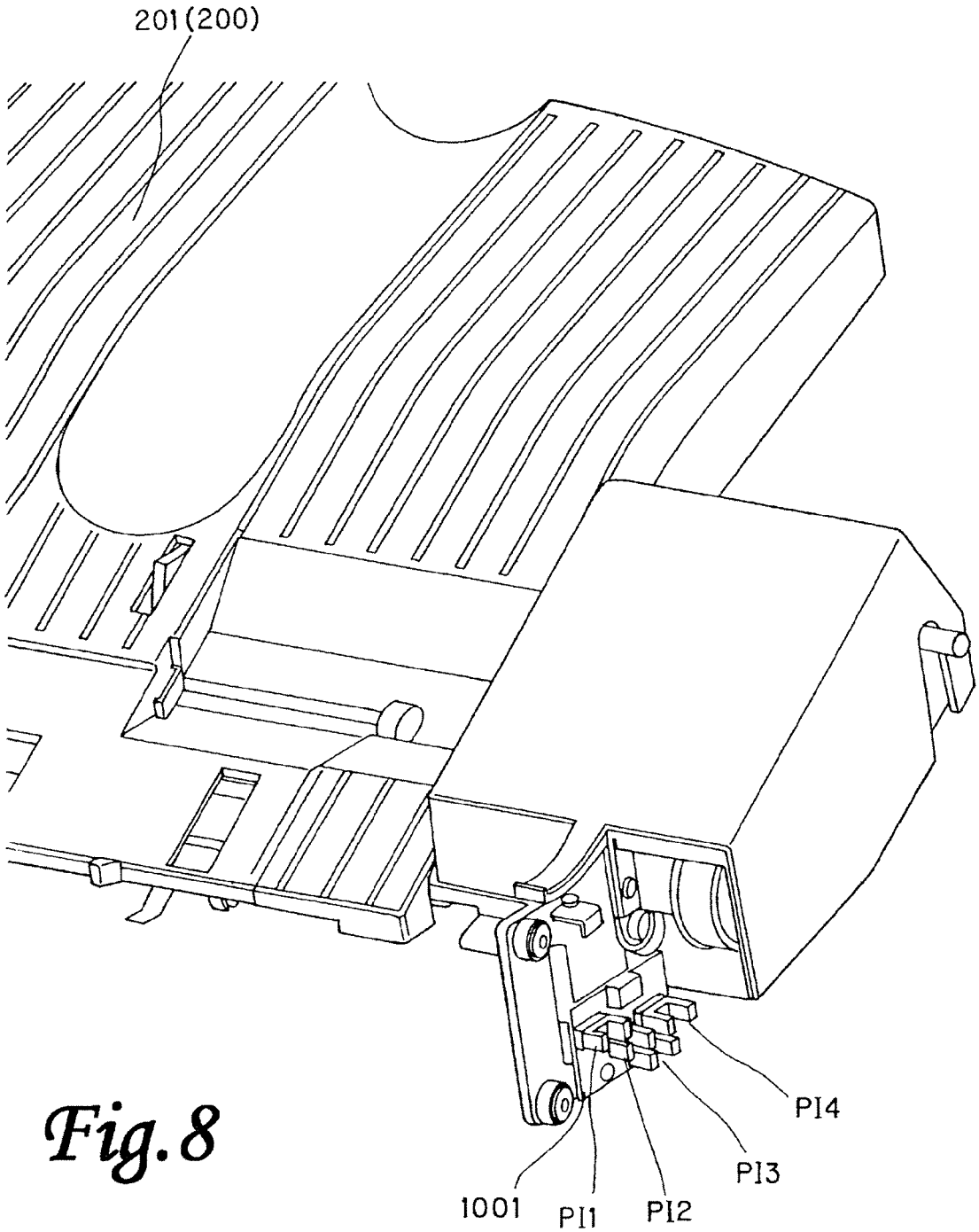
FIG. 8 is a perspective view showing a state in which a tray lower limit position detecting portion for detecting the position of a tray in a vertical direction in the sheet processing apparatus of one embodiment of the invention is mounted.

Next, the position detecting method of the tray will be described. FIG. 8 shows a mounting state of an area detecting board 1001 as a tray lower limit position detecting portion for detecting the position of each tray in the vertical direction, provided on each of the sample tray 201 and the stack tray 200.

The area detecting board 1001 has four photo interrupters PI1, PI2, PI3, and PI4. A vertical position is detected based on a combination of outputs of the four photo interrupters PI1, PI2, PI3, and PI4.

As shown in FIG. 6, the sample trays 201 and the stack trays 200 are supported with mechanical gear on front supporting column 1000*a* and rear supporting column 1000*b* within the outer sheath of the sheet processing apparatus 1.

Figure 9:
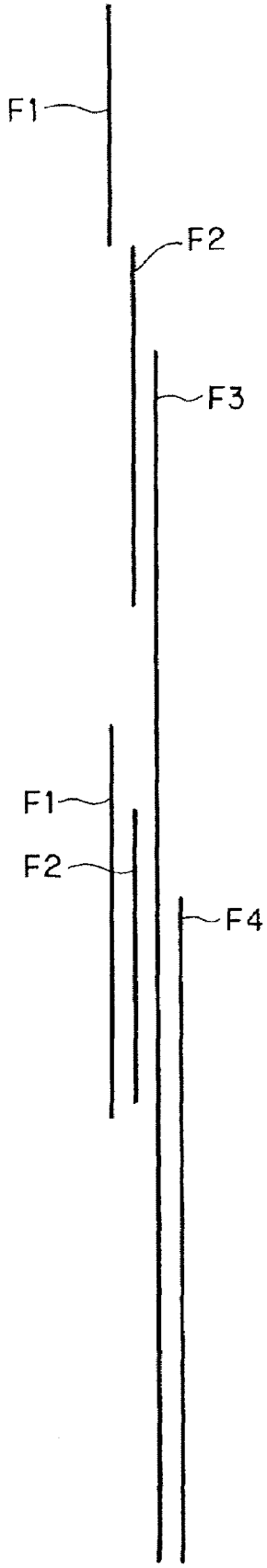
FIG. 9 is a schematic diagram showing four kinds of flags in the sheet processing apparatus of one embodiment of the invention.
Figure 10:
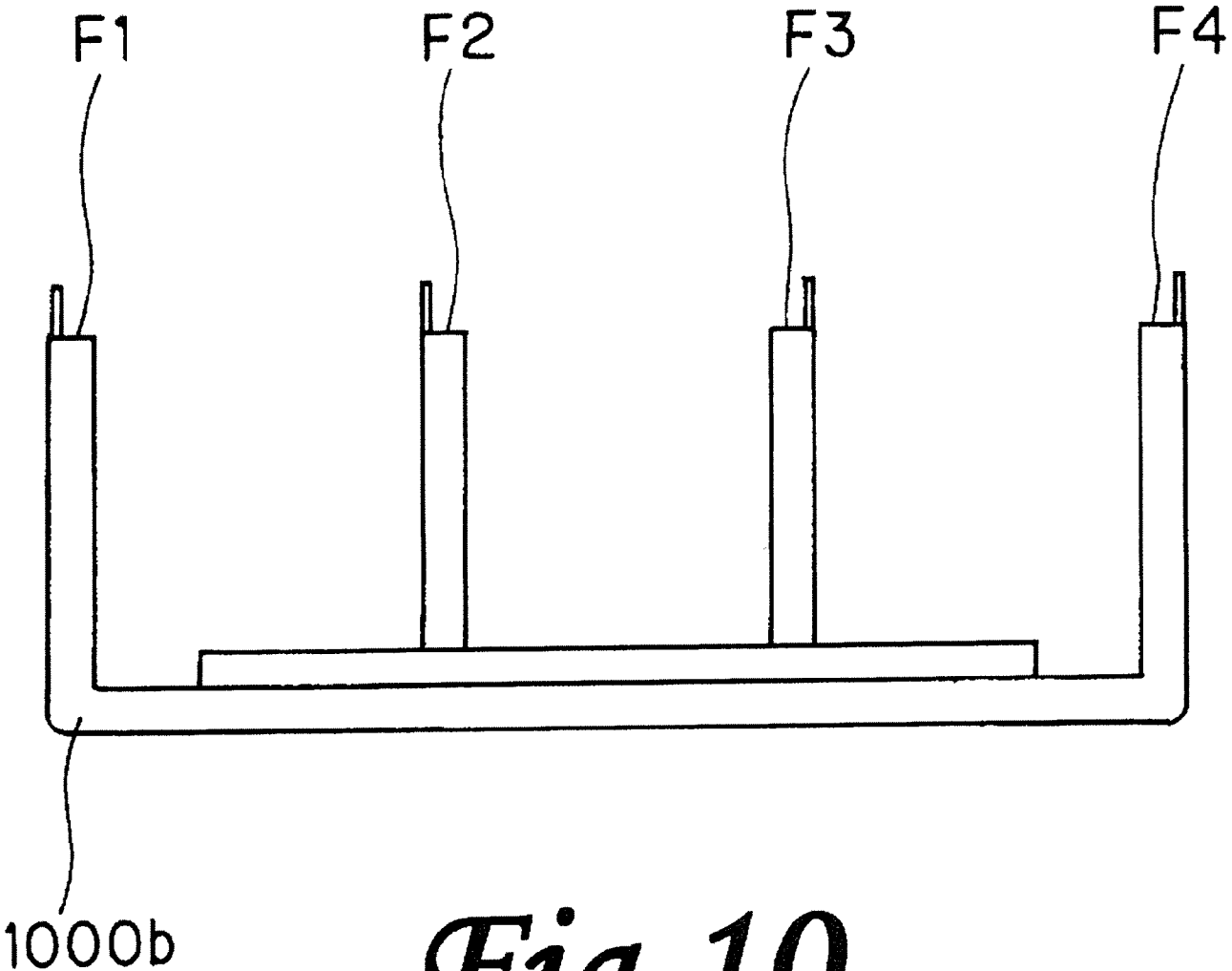
FIG. 10 is a top view of rear supporting columns of the sheet processing apparatus according to one embodiment of the invention.

These sample tray 201 and stack tray 200 can be moved vertically by a motor (not shown) installed internally. As shown in FIG. 9, four kinds of flags F1, F2, F3, and F4 are disposed vertically within the rear supporting column 1000*b*. FIG. 10 shows top view of the rear supporting column 1000*b*.

Figure 11:
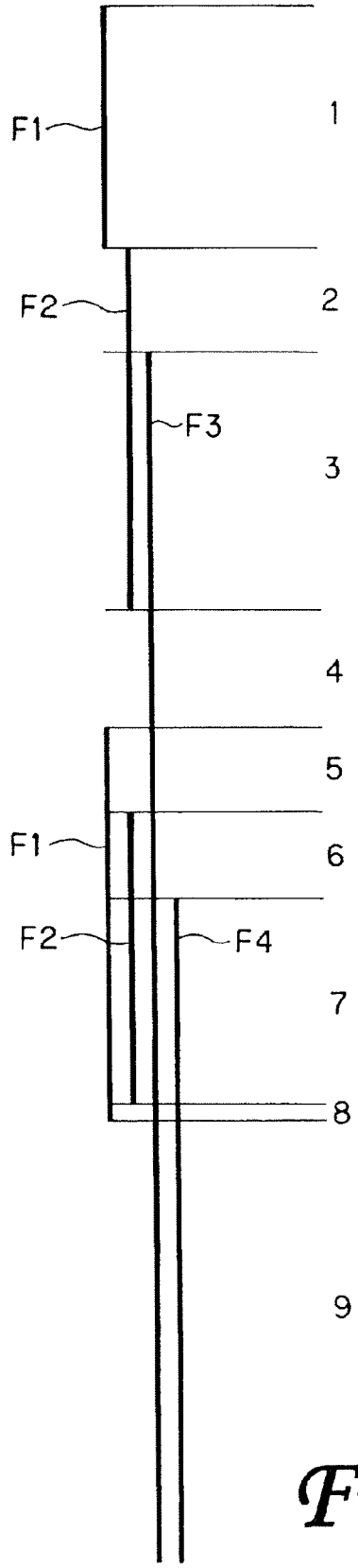
FIG. 11 is a schematic diagram showing an area detecting board in the sheet processing apparatus of one embodiment of the invention.
Figure 12:
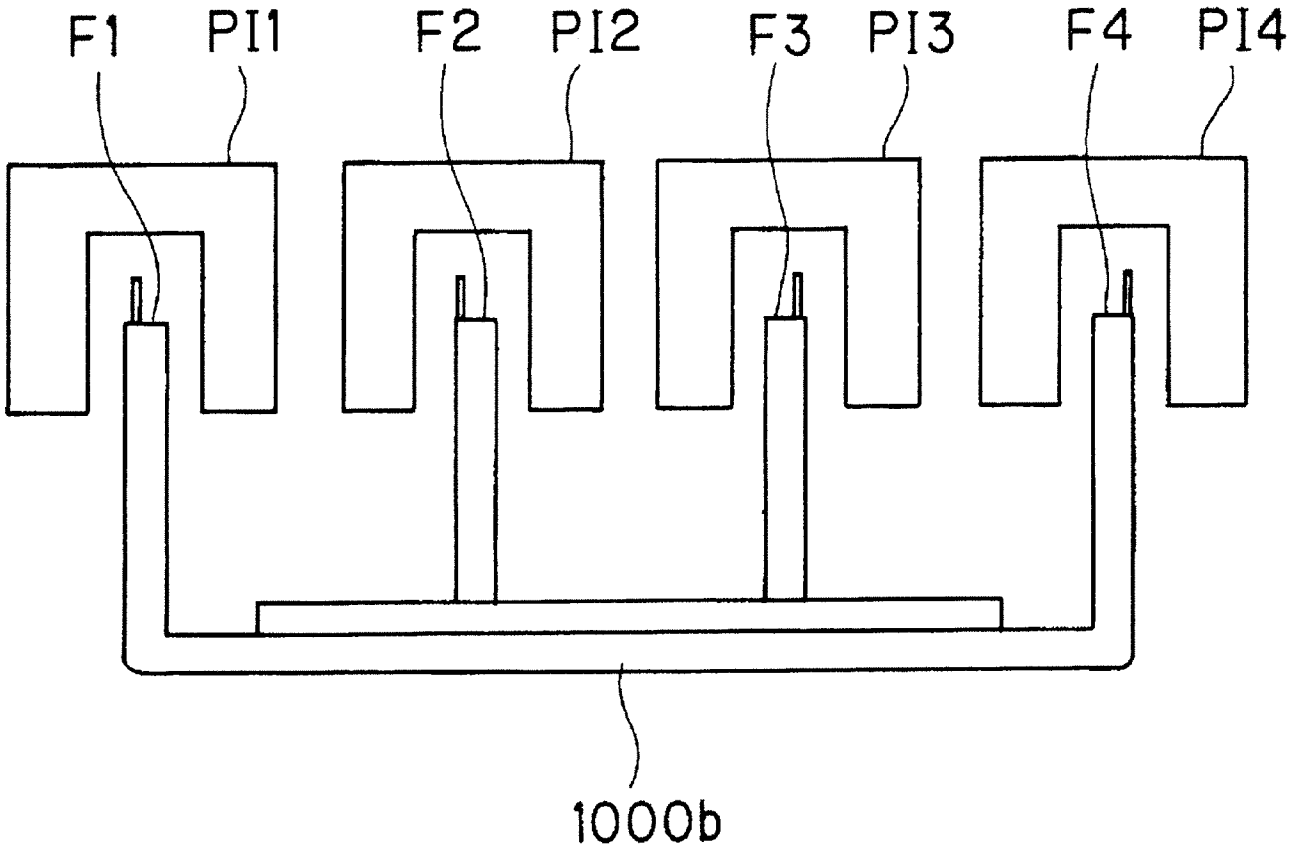
FIG. 12 is a schematic diagram for explaining a detecting method of the area detecting board in the sheet processing apparatus of one embodiment of the invention.

The area detecting boards 1001 are disposed as shown in FIG. 11. Presence or absence of flag is detected by sensors in the area detecting board 1001 when the sample tray 201 and the stack tray 200 move vertically. Eight grade detection is enabled in nine areas as shown in FIG. 11 by combination of four sensors of the photo interrupters PI1, PI2, PI3, and PI4 shown in FIG. 12 and four kinds of flags F1, F2, F3, and F4.

More specifically, assume that an output when a flag is detected is High in each of the photo interrupters PI1, PI2, PI3, and PI4. When the sample tray 201 is descended and the output of the area detecting board 1001 turns to High, Low, High, Low in PI1 to PI4 respectively when the lower limit position of the sample tray 201 is area 5 (refer to FIG. 11), it is detected that the sample tray 201 reaches the lower limit position.

Likewise, the vertical position of a detected stack tray 200 can be detected. In case of the stack tray 200, its position can be detected with the photo interrupters PI1, PI2, PI3, PIN and the area detecting board 1001. When the stack tray 200 is descended and the output of the area detecting board 1001 turns to Low, Low, High, High in the order of PI1 to PI4 if the lower limit position of the stack tray 200 is area 9, it is detected that the sample tray 201 reaches the lower limit position.

(Stacking Action)

Next, an actual stacking action of the embodiment of the invention will be described. FIG. 7 shows a flow chart of the stacking action of the embodiment.

As shown in FIG. 7, which stacking mode the stacking mode set by user with the operating portion 308 is determined by the control unit 950 in step S101.

If the stacking mode specified by user is determined to be large capacity stacking mode by the control unit 950 (step S101: YES), the procedure proceeds to step S102, in which whether the sheets are stacked on both the sample tray 201 and the stack tray 200 is checked.

If both the trays are stacked with sheets in step S102 (step S102: NO), the procedure proceeds to step S103, in which a message instructing user to remove the sheets from the tray is displayed based on an instruction signal from the control unit 950 on the display portion 308*a* of the operating portion 308 and after that, the procedure proceeds to step S104.

In step S104, whether or not both the sample tray 201 and the stack tray 200 are stacked with sheets is checked again. If image formation is started with the sheets not removed from the tray based on an operation of the operating portion 308 by user (step S104: NO), the procedure proceeds to step S109, in which stacking of the sheets is executed on the normal stacking mode.

On the other hand, if it is determined that any tray is not stacked with sheets in step S102 or step S104 (steps S102, S104: YES), the procedure proceeds to step S105.

In step S105, after the quantity of sheets scheduled to be stacked by a current job (image forming processing) is computed by the control unit 950 which functions as a computing portion according to an equation of (number of documents)×(number of sets)

whether or not this computation result is higher than the stacking upper limit quantity of the normal stacking mode is determined.

If it is determined that the computation result is higher than the stacking upper limit quantity of the normal stacking mode in step S105 (step S105: NO), the procedure proceeds to step S108, in which sheets are stacked according to the large capacity stacking mode. Conversely if it is determined that the computation result is lower than the stacking upper limit quantity of the normal stacking mode (step S105: YES), the procedure proceeds to step S106, in which a message indicating whether or not sheets may be stacked on the normal stacking mode is displayed on the operating portion 308 so that user is notified thereof.

After that, the procedure proceeds to step S107, in which the system stands by for input of an instruction by user to the operating portion 308. If an instruction of stacking under the normal stacking mode is input to the operating portion 308 by user, the procedure proceeds to step S109, in which the stacking of the sheets is carried out on the normal stacking mode. On the other hand, if an instruction of stacking under the large capacity stacking mode is input to the operating portion 308 by user, the procedure proceeds to step S108, in which the stacking of the sheets is carried out on the large capacity stacking mode.

If the mode set by user is normal stacking mode in the above-mentioned step S101 (step S101: NO), the procedure proceeds to step S110, in which whether or not no sheet is stacked on the sample tray 201 and the stack tray 200 is determined. If any tray is stacked with sheets (step S110: NO), the procedure proceeds to step S114 in which the sheets are stacked on the normal stacking mode.

On the other hand, if no sheet is stacked on the tray in step S110, the procedure proceeds to step S111, in which the quantity of sheets scheduled to be stacked by a current job is computed according to an equation of (number of documents)×(number of sets).

If this computation result is higher than the stacking upper limit quantity of the normal stacking mode (step S111: NO), the procedure proceeds to step S112, in which a message of "whether or not stacking of sheets may be executed on the large capacity stacking mode" is displayed on the operating portion 308 by the control unit 950.

Then, the procedure proceeds to step S113, in which the system stands by for input by user to the operating portion 308. After that, if user inputs an instruction to the operating portion 308 to give an instruction of stacking on the large capacity stacking mode by user (step S113: YES), the procedure proceeds to step S115, in which stacking of the sheets is carried out on the large capacity stacking mode. On the other hand, if user inputs an instruction to the operating portion 308 to give an instruction of canceling stacking on the large capacity stacking mode by user (step S113: NO), the procedure proceeds to step S114, in which stacking of the sheets is carried out on the normal stacking mode.

Although the embodiment of the present invention has been described in details, the present invention is not restricted to the above-described embodiment but may be modified in various ways based on the spirit of the technical philosophy of the invention.

Specifically, although the above-described embodiment determines the sheet loading capacity by counting the number of sheets, this embodiment is not restricted to this method, but it is permissible to adopt a structure comprising an upper tray lower limit position detecting portion for detecting two lower limit positions of a stacking tray (upper tray) located on the upper side, a lower tray lower limit position detecting portion for detecting the lower limit position, of a stacking tray (lower tray) located on the lower side, a proximity detecting sensor for detecting a distance between the upper tray and the lower tray, and a sheet surface detecting sensor for maintaining the top surfaces of sheets stacked on the upper tray and lower tray constantly so as to determine whether or not the maximum loading capacity is reached.

If the amount of sheets which can be stacked on each of the upper tray and the lower tray is grasped by detecting the position of each of the upper tray and lower tray with the above-described area detecting board and then detecting a current loading capacity with the sheet surface detecting sensor, any sheets stacked on the tray do not need to be removed when the large capacity stacking mode is set up. That is, it is not always necessary to remove the sheets on the tray to turn on the large capacity stacking mode.

This application claims priority from Japanese Patent Application No. 2005-249994 filed Aug. 30, 2005, which is hereby incorporated by reference, herein.

What is claimed is:

1. A sheet stacking apparatus comprising:

an upper discharge port and a lower discharge port, located below the upper discharge port, each capable of discharging a sheet;

a stacking portion having an upper tray and a lower tray, located below the upper tray, each capable of stacking sheets discharged from one of the upper and lower discharge ports and moving vertically; and a controller which controls the vertical motion of the upper tray and the lower tray, wherein the controller is capable of setting a first mode and a second mode in which a lower limit position of the upper tray stacked with sheets discharged from the upper discharge port is different, the lower limit position of the upper tray in the first mode is above the lower discharge port, the lower limit position of the upper tray in the second mode is a position in which the upper tray or sheets stacked on the upper tray blocks the lower discharge port, and the controller executes change-over between the first mode and the second mode depending on the total quantity of sheets scheduled to be discharged to the upper and the lower trays.

2. The sheet stacking apparatus according to claim 1, further comprising an upper tray lower limit position detecting portion which detects the lower limit position in the first mode and in the second mode of the upper tray and a lower tray lower limit position detecting portion which detects the lower limit position of the lower tray.

3. The sheet stacking apparatus according to claim 1, wherein if the loading capacity of the sheets stacked on the lower tray reaches the maximum loading capacity under the second mode, the controller controls to start stacking of the sheets on the upper tray.

4. The sheet stacking apparatus according to claim 1, wherein the upper discharge port corresponds to the upper tray and the lower discharge port corresponds to the lower tray.

5. The sheet stacking apparatus according to claim 1, wherein if the sheets are stacked on at least one of the upper and lower trays, the controller controls so as not to execute stacking of the sheet based on the second mode.

6. An image forming apparatus comprising:

an image forming portion which forms an image on the sheet; and the sheet processing apparatus according to claim 1 which is stacked with sheets sent from the image forming portion.

7. A sheet processing apparatus comprising:

a post-processing unit which executes post-processing on the sheet; and the sheet stacking apparatus according to claim 1.

8. An image forming apparatus comprising:

an image forming portion which forms an image on the sheet; and the sheet processing apparatus according to claim 7 which executes post-processing on the sheets sent from the image forming portion.

9. The image forming apparatus according to claim 6, further comprising:

an input portion in which information of the number of documents and the number of sets is input; and a computing portion which computes the total quantity of sheets to be discharged to the upper and lower trays from the information of the number of documents and number of sets fed from the input portion, wherein the controller switches the first mode and the second mode depending on a computation result by the computing portion.

10. The image forming apparatus according to claim 9, wherein if the total quantity of the sheets discharged depending on the computation result by the computing portion exceeds the maximum loading capacity of the upper tray under the first mode, the controller switches to the second mode.

11. The image forming apparatus according to claim 9, wherein if the total quantity of the sheets discharged depending on the computation result by the computing portion is lower than the maximum loading capacity of the upper tray under the first mode, the controller switches to the first mode.

12. The image forming apparatus according to claim 6, further comprising:

an operating portion which selects the first mode and the second mode.

13. The sheet stacking apparatus according to claim 1, wherein the lower limit position of the upper tray in the second mode is above a top surface of sheets of a maximum loading capacity stacked on the lower tray.

* * * * *